United States Patent [19]

Gana

[11] Patent Number: 4,944,441

[45] **Date of Patent: * Jul. 31, 1990**

[54] TAPE CUTTING DISPENSER

[76] Inventor: John W. Gana, 5077 Landisville Rd., Doylestown, Pa. 18901

[ * ] Notice: The portion of the term of this patent subsequent to Feb. 28, 2006 has been disclaimed.

[21] Appl. No.: 284,188

[22] Filed: Dec. 14, 1988

Related U.S. Application Data

[63] Continuation-in-part of Ser. No. 946,954, Dec. 19, 1986, Pat. No. 4,807,789.

[51] Int. Cl.[5] ..... B65H 35/04

[52] U.S. Cl. ..... 225/16; 225/11; 225/20; 225/91

[58] Field of Search ..... 225/10, 11, 16, 19, 225/91, 92, 20; 30/329, 338, 336, 337, 335

[56] References Cited

U.S. PATENT DOCUMENTS

| | | | |
|---|---|---|---|
| 941,566 | 11/1909 | Fleming | 30/338 |
| 1,418,352 | 6/1922 | Bach et al. | 30/336 |
| 2,593,291 | 4/1952 | Garik | 225/11 X |
| 2,710,063 | 6/1955 | Krueger | 225/11 X |
| 2,889,975 | 6/1959 | Hanlon | 225/19 |
| 3,204,949 | 9/1965 | Kieslich | 225/11 X |
| 4,175,685 | 11/1979 | Niles | 225/19 |
| 4,807,789 | 2/1989 | Gana | 225/11 X |

*Primary Examiner*—Frank T. Yost
*Assistant Examiner*—Rinaldi Rada
*Attorney, Agent, or Firm*—Joseph W. Molasky

[57] ABSTRACT

An improvement for a tape dispensing apparatus equipped with a device for cutting tape into discrete segments. A straight-edged blade vertically disposed and secured within a U-shaped support provides enhanced cutting abilities while protecting the operator from injurious contact with the blade cutting edges. The support is also adapted to allow easy removal of the blade after extended use without allowing excessive adhesive build-up on the cutting edge from adhering to the assembly. The blade is firmly maintained within the support via a spring tab which furnishes stability to the cutting assembly.

9 Claims, 3 Drawing Sheets

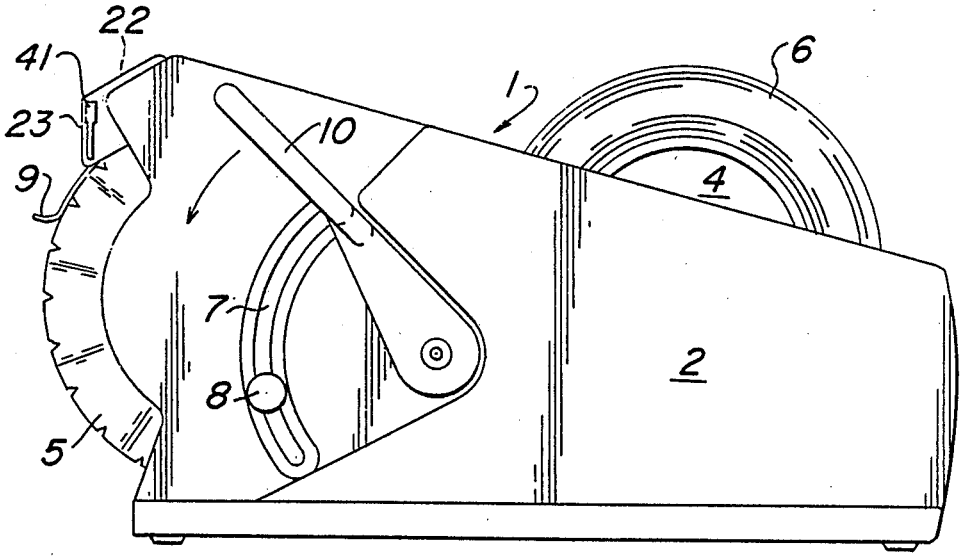
FIG. 1
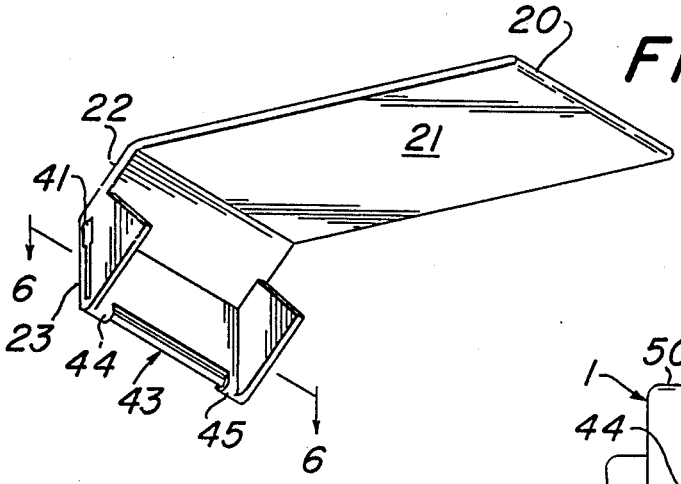
FIG. 2
FIG. 3
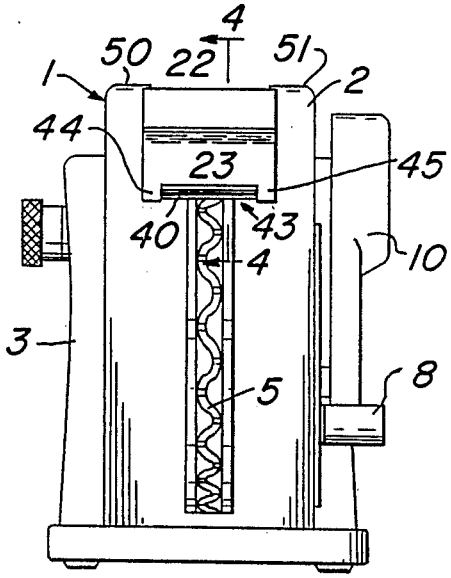
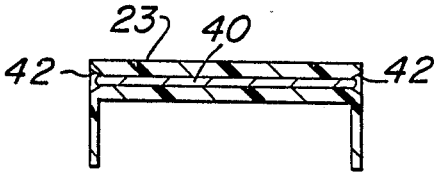
FIG. 6

TAPE CUTTING DISPENSER

This application is a continuation-in-part application of Ser. No. 946,954, filed Dec. 19, 1986 now U.S. Pat. No. 4,807,789.

BACKGROUND

This invention relates to an improved apparatus for dispensing and cutting tape segments fed from a definite-length tape dispenser.

Specifically, this invention relates to an apparatus for dispensing and cutting pre-determined lengths of tape by bringing the tape segment into engagement with the cutting edge of a straight-edged blade. The blade is shielded at its terminii or corners by a guard which protects the operator against inadvertent contact. Means have also been juxtaposed to the blade for enhancing its stabilization and to enable easy removal of a used blade having excessive adhesive build-up.

DESCRIPTION OF THE PRIOR ART

A definite-length dispenser is one which provides a pre-determined measure of tape from a tape roll in a single stroke. The dispenser is operated by a lever arm which causes a tape drum to rotate and feed a precise length of tape onto a feeder wheel, whereupon, the tape segment is lifted upwardly from the wheel and brought into cutting engagement with a corrugated blade. In general, the length of the dispensed tape is equal to the distance traveled by said arm.

One difficulty with known dispensers is the prominent display given to the corrugated blade so that the entire cutting edge including the end segments or terminii, are fully exposed. This cutting edge and terminii are a hazard to the operator because the dispensed tape segment must be gripped at one end while pulling upwardly and this operation often brings the thumb and forefinger into injurious contact with the ends of the blade.

Moreover, the corrugated blade design affords an uneven cut which often results in ragged or frayed edges. This condition is particularly damaging when the tape is comprised of reinforcing fiber strands because a corrugated blade will cause the strands to separate and thus weaken the tape segment.

Also, corrugated blades require an appreciable setup time because the blade must be secured by screws between a cover and a blade clamp and the blade must be centered to ensure an effective cut.

Another difficulty that has been encountered with prior art tape dispensers which utilize non-corrugated blades has been the requirement for precision in the manufacture of a slotted aperture that is needed for positioning and holding such blades. This complicates and adds to the expense of manufacture which is undesirable in producing tape dispensers for a competitive economy.

Another shortcoming of present-day tape dispensers has been related to blade removal after a period of extended use. After repeated use adhesive tends to accumulate on the cutting edge of the blade and said blade can only be removed with difficulty due to the tendency of the accumulated adhesive to adhere to various parts of the assembly.

Accordingly, there is a need for improvement in tape dispensers equipped with corrugated and straight-edged blades.

THE INVENTION

It is an object of this invention to provide an apparatus having improved means for cutting tape segments from a definite-length tape dispenser.

Another object is to provide a tape dispenser equipped with a straight-edged blade which can be installed easily in a fraction of the time required for an assembly equipped with a corrugated blade.

It is another object of the invention to enable facile removal of a blade after extended use and with extensive adhesive build-up, as well as to maintain the blade firmly in position despite dimensional variations in various blades and in a slotted aperture into which the blade is positioned.

Still another object is to provide a tape dispensing assembly in which the severing blades are covered at their terminii to protect the operator against inadvertent injurious contact.

A further object provides for a tape dispensing assembly in which the severing operation is performed by a straight-edged blade with less effort than is required with a corrugated blade. Moreover, the blades of this invention are inexpensive and their clean even cut makes it possible to produce tape segments smaller in size than was heretofore possible.

Briefly stated, this invention relates to a tape dispensing apparatus equipped with a novel support means for slidably receiving and securing a straight-edged blade. The blade support consists essentially of a cover assembly which terminates in a vertical support equipped with slotted end openings for receiving the blade. This vertical support is essentially U-shaped and its longitudinal segment includes a recessed cutout which allows only the cutting portion of the blade to remain exposed while protecting the user from inadvertent contact with its terminal ends.

Unlike commercial dispensers which position a corrugated blade at about a 45° angle, the present assembly positions the blade within a vertical support on a plane which intersects the circular path of the tape dispensing wheel. In practice, this apparatus can be equipped with a new cutting edge by simply impressing one of the blade ends into the receiving aperture of the vertical support until it is properly centered, an operation which is facilitated by the presence of beveled end openings and which can be effected within seconds without the use of screws or other retaining means.

The invention further relates to a spring tab arrangement that firmly locates the blade within an aperture provided within the apparatus in order to obviate problems associated with variations in blade and blade opening dimensions.

Another feature of the invention provides a well that surrounds the cutting edge of the blade when positioned within the apparatus. The well permits easy removal in the event that the blade must be replaced without allowing adhesive that may have built up on the cutting edge from attaching itself to other parts of the assembly.

These and other features of the invention will be more clearly understood by reference to the appended Drawings and the Preferred Embodiments which follow.

THE DRAWINGS

FIG. 1 is a side elevational view of the dispensing apparatus of this invention with the cover assembly installed.

FIG. 2 is an underside view of the cover assembly illustrating the blade-holding segment.

FIG. 3 is a front elevational view of the dispensing apparatus shown in FIG. 1.

FIG. 6 is a sectional view of the blade-holding segment shown in FIG. 2 along line 6—6.

Figure 4:
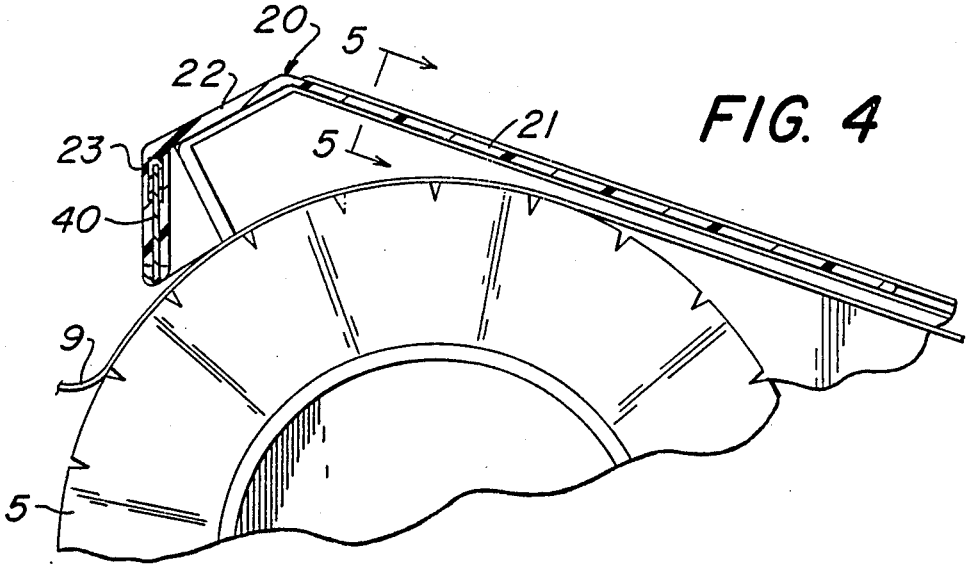
FIG. 4 is a partial sectional view of the dispensing apparatus shown in FIG. 3 along line 4—4.

This invention will now be described by reference to precise embodiments but it is to be understood that the following description is for illustration purposes only and the invention is not to be construed as being limited thereto.

DESCRIPTION OF THE PREFERRED EMBODIMENTS

The dispensing apparatus 1 consists essentially of a right-side frame 2 and a left-side frame 3 which are joined to form a housing in which are disposed a revolving tape drum 4 and a feed wheel 5 of fluted design (FIG. 1). The circumference of tape drum 4 is such that it fits snugly within a tape roll opening so that the combination of said drum and the tape roll 6 can be mounted together within the apparatus as a unit.

The feed wheel 5 is actuated for rotating movement by depressing the lever arm 10 within pathway 7 so as to dispense onto the fluted surface of said wheel a tape segment 9 equal in length to the distance traveled by said lever arm.

Disposed within pathway 7 for slidable engagement is an adjustable knob 8 which can be slidably moved and threadedly secured to provide a stop for the lever arm 10. When knob 8 is secured within said pathway at an elevated position a tape segment of abbreviated length is obtained, whereas, the engagement of said knob at some lower position results in a tape segment of proportionately greater length.

Figure 5:
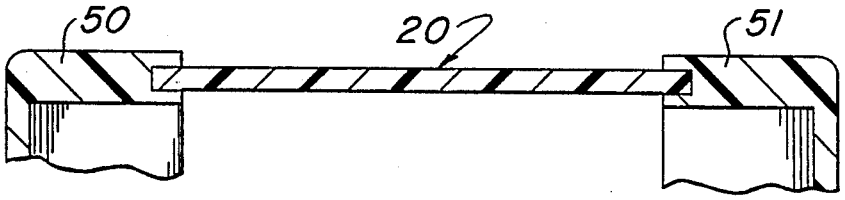
FIG. 5 is a sectional view of the cover assembly in its installed mode taken along line 5—5 of FIG. 4.

Mounted above the feed wheel 5 is a cover assembly 20 which is adapted for sliding engagement within tracks located in housing segments 50 and 51 of the dispensing apparatus (FIGS. 4 and 5). This assembly consists essentially of an elongated flat cowling 21, an angular segment 22 which lies at an angle of 45° with respect to said cowling and a vertically disposed segment 23 equipped with cavity or aperture means 41 for accommodating a straight-edged blade 40.

The blade is slidingly received by the cavity 41 and bevels 42 on both sides of the cavity opening facilitate blade entry. The blade 40 is equipped on one side with a finger guard 54 and the cutting edge is finely honed to provide evenly cut tape segments which are neither ragged or frayed.

This invention will now be illustrated by reference to the loading and cutting features of the present apparatus.

In practice, the apparatus is loaded by first removing the cover assembly 20 and installing within the housing a tape roll 6 fitted onto an accommodating drum 4. This combination of drum and tape roll are inserted within the dispenser for rotating movement so that the tape can be dispensed from the top of the roll and pulled forward from impressing same onto the feed wheel 5. The cover assembly 20 is replaced by slidably engaging same within tracks provided by housing segments 50 and 51 and knob 8 is secured within the pathway 7 to provide a stop for the lever arm 10. The securing of knob 8 along an elevated portion of the pathway affords a tape segment of abbreviated length, whereas, the securing of said knob at a lower position results in a tape segment of greater length.

The tape is dispensed from the tape roll 6 by depressing the lever arm downwardly within the pathway 7 until it comes into contact with the stop 8 as a result of which the tape drum is caused to rotate and feed onto the fluted surface of the feed wheel 6 a tape segment of predetermined length (FIGS. 1 and 4). This tape segment is severed by lifting the tape end upwardly from the feed wheel and bringing same into contact with the cutting edge of the straight-edged blade 41 with a sidewise motion. This blade severs the tape cleanly and without the frayed edges which characterize tapes cut with corrugated blades.

A new blade is inserted into the dispenser by impressing one end of the blade 40 into the beveled opening 42 in a slidable manner and this sliding engagement is maintained until the blade is centered within cavity 41. This procedure will also serve to replace a used blade because it simultaneously ejects the former from an opposite end opening as the new blade is centered. Once the new blade has been inserted only the center or cutting segment of the blade is exposed and this segment is recessed within the indentation shown generally as 43 in FIGS. 2 and 3. Within this indentation or recess the blade extends downwardly in a vertical mode so that its cutting edge lies immediately above the tape segment on a plane which intersects the path of said wheel. The terminii or ends of the blade are not exposed and they are shielded instead by projecting segments 44 and 45 so as to protect the user from the injuries which can result from inadvertent contact.

Figure 7:
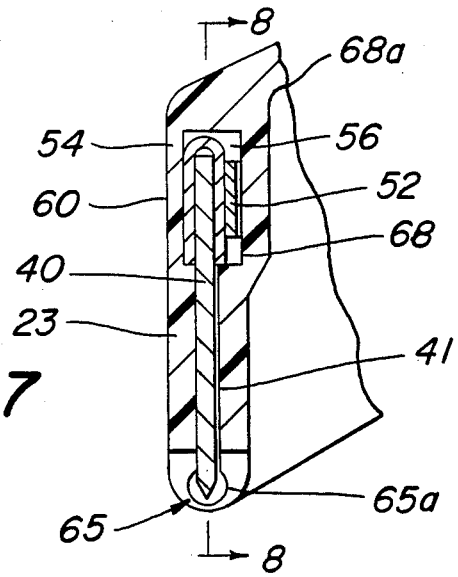
FIG. 7 is an enlarged sectional view of the vertically disposed segment of a cover assembly and illustrating the well surrounding portions of the blade's cutting edge as well as the spring tab located against an upper region of the blade.
Figure 8:
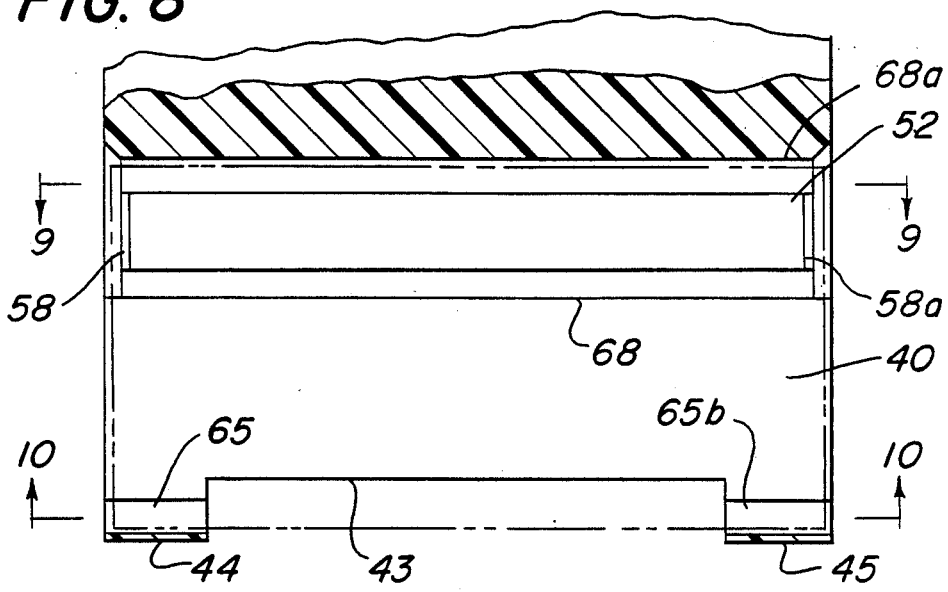
FIG. 8 is a sectional view of the vertically disposed segment taken along the line 8—8 of FIG. 7.

Further enhancements to the dispensing apparatus 1 of FIGS. 1–6 are illustrated in FIGS. 7–10. In FIG. 7 the vertically disposed segment 23 is depicted wherein the cavity 41 inclusive of the pocket 56 is formed. In the past it was necessary to fabricate the cavity 41 and pocket 56 with precision in order to slidably receive and frictionally engage the blade 40 in a proper position for cutting a tape segment 9; in addition, wear was introduced into the cavity and pocket after repeated insertions and removals of respective new and used blades such that the blade could not be properly held in place after an extended use period. In order to enhance the frictional relationship between the blade 40 and the cavity 41 the pocket 56 is accommodated to allow a leaf-type spring 52 to be inserted within. The spring 52 is attached to a section 57 of the vertical support 23 in a cantilever fashion across the width of the finger guard 54. This may be viewed in FIG. 8 where the relationship of the blade 40 shown in phantom outline is held against the spring 52, which includes bevels 58, 58*a*.

Figure 9:
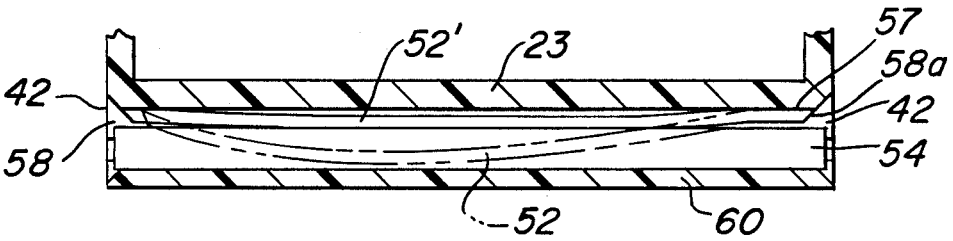
FIG. 9 is a sectional view of the spring tab bearing against the cutting blade and taken along the line 9—9 of FIG. 8.

The spring 52 is maintained within the pocket 56 having an outline represented by the shelf 68 and the upper limit 68*a*. The blade is shown as exposed within the indentation 43 and between the proJecting segments 44, 45. The relationship between the spring 52 in both an active and passive state is more graphically depicted in FIG. 9. FIG. 9 illustrates in phantom the position of the spring 52 in the passive mode when the blade 40 (See FIG. 7) is not positioned within the cavity 41. When the blade 40 is inserted into the cavity 41 the spring 52 becomes essentially straightened except for a slight bow as shown with solid lines. In this position the spring 52' exerts an outward force against the finger guard 54 or upper region of the blade 40 to urge the blade 40 against the rear section 60. This keeps the blade 40 firmly in place even after the pocket 56 becomes worn due to the repetitious insertion and removal of said blades within the cavity 41. The action of the spring 52' also allows for some variations in blade dimensions and eliminates the need for precision tooling and manufacturing techniques with respect to blade fabrication.

Figure 10:
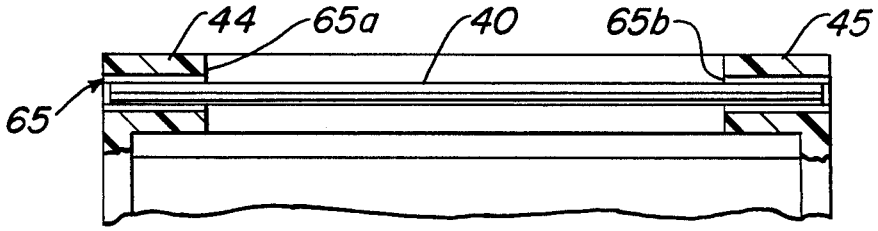
FIG. 10 is a sectional view of the cutting edge of the blade with respect to the circular well taken along line 10—10 of FIG. 8.

The well shown generally as 65 in FIG. 7 and shown in section in FIG. 10 obviates the problem of adhesive gum-up of the blade 40 after extended use. The well 65 is formed in two sections 65*a*, 65*b* and are located in respective proJecting segments 44, 45. The blade 40 is located within wells 65*a* and 65*b* to provide space on either side of the blade's cutting edge and thus facilitate the blade's removal from the dispenser without touching any of the projecting segment assembly.

This invention has been described by reference to precise embodiments but it will be appreciated by those skilled in the art that this invention is subject to various modifications and to the extent that those modificatiosn would be obvious to one of ordinary skill they are considered as being within the scope of the appended claims.

What is claimed is:

1. An apparatus for dispensing predetermined lengths of tape which comprises:

(1) a framed housing in which there is disposed a revolving tape drum for supporting a tape roll;

(2) a feeder wheel onto which said tape is dispensed;

(3) a lever arm for rotating said feeder wheel through a succession of sequenced movements so as to feed said tape incrementally onto the peripheral surface of said wheel;

(4) a cover assembly slidably engaged within grooved openings in said housing above said feed wheel, said assembly terminating in a vertical segment which includes a slotted aperture having two end openings for receiving a straight-edged blade;

(5) a spring means located within said slotted aperture; and (6) a straight-edged blade positioned within said aperture and against said spring means to overcome variations in blade dimensions and a worn condition of said aperture.

2. The apparatus according to claim 1 wherein said blade is on a plane which intersects the circular path of said wheel.

3. The apparatus according to claim 1 wherein said cover assembly consists essentially of a flat elongate cowling to which the vertical segment is joined by an angular segment.

4. The apparatus according to claim 1 wherein said angular segment lies at an angle of about 45° with respect to said elongate section.

5. The apparatus according to claim 1 wherein said vertical segment consists essentially of a generally U-shaped member into which said blade is slidingly inserted.

6. The apparatus according to claim 5 wherein said U-shaped member includes a recessed cutout for exposing a section of the cutting edge of said blade and forming end sections adjacent said cutout to cover the termini of the blades.

7. The apparatus according to claim 6 wherein said ends of said U-shaped member include well means to prevent adherence of excessive excess adhesive on said blade from touching the assembly during blade removal.

8. The apparatus in accordance with claim 7 wherein said well means are circular in shape.

9. An apparatus for dispensing predetermined lengths of tape which comprises:

(1) a framed housing in which there is disposed a revolving tape drum for supporting a tape roll;

(2) a feeder wheel onto which said tape is dispensed;

(3) a lever arm for rotating said feeder wheel through a succession of sequenced movements so as to feed said tape incrementally onto the peripheral surface of said wheel;

(4) a blade cutting member;

(5) a cover assembly slidably engaged within grooved openings in said housing above said feed wheel, said assembly terminating in a vertical segment which consists essentially of a generally U-shaped member including a slotted aperture for receiving said blade member, a recessed cutout for exposing a section of the cutting edge of said blade wherein the ends of said U-shaped member adjacent said cutout cover the termini of said blade to protect against injurious contact;

(6) spring means located within said slotted aperture and against said blade member to overcome variations in blade dimensions and a worn condition of said aperture; and (7) well means located within the ends of said U-shaped member and juxtaposed to said cutting edge to prevent excess adhesive on said blade from contacting the assembly during blade removal.

* * * * *